US008539891B2

(12) United States Patent
Minkara et al.

(10) Patent No.: US 8,539,891 B2
(45) Date of Patent: Sep. 24, 2013

(54) METHOD FOR REDUCING AIR FLOW WHEN OPERATING A COAL BURNER

(71) Applicant: Headwaters Energy Services Corporation, South Jordan, UT (US)

(72) Inventors: Rafic Minkara, Kennesaw, GA (US); N. Stan Harding, North Salt Lake, UT (US)

(73) Assignee: Headwaters Energy Services Corporation, South Jordan, UT (US)

( * ) Notice: Subject to any disclaimer, the term of this patent is extended or adjusted under 35 U.S.C. 154(b) by 0 days.

(21) Appl. No.: 13/632,684

(22) Filed: Oct. 1, 2012

(65) Prior Publication Data

US 2013/0025514 A1 Jan. 31, 2013

Related U.S. Application Data

(62) Division of application No. 12/182,656, filed on Jul. 30, 2008.

(51) Int. Cl.

| | |
|---|---|
| ***F23K 3/02*** | (2006.01) |
| ***F23L 9/00*** | (2006.01) |
| ***F23D 1/00*** | (2006.01) |

(52) U.S. Cl.
USPC ..... 110/342; 110/347; 110/348; 44/620

(58) Field of Classification Search
USPC ..... 44/627, 620; 110/347, 263, 265, 110/342, 345, 348; 423/239.1; 324/117 R
See application file for complete search history.

(56) References Cited

U.S. PATENT DOCUMENTS

| | | | | |
|---|---|---|---|---|
| 4,464,625 | A * | 8/1984 | Lienhard et al. | 324/117 R |
| 5,908,003 | A * | 6/1999 | Hura et al. | 110/345 |
| 2006/0228282 | A1 * | 10/2006 | Zhou et al. | 423/239.1 |

* cited by examiner

*Primary Examiner* — James Goloboy
*Assistant Examiner* — Chantel Graham
(74) *Attorney, Agent, or Firm* — Workman Nydegger

(57) ABSTRACT

An initial coal is cleaned to reduce ash content by ≥20% and yield refined coal that optimizes combustion air flow through a coal burner. This permits conveyance of pulverized refined coal in suspended condition through feeder pipes of the coal burner using reduced air flow compared to the quantity of air required to convey pulverized initial coal in suspended condition through the feeder pipes. This reduces oxygen in the primary combustion zone, lowering conversion of fuel nitrogen into NOx and instead converting it into $N_2$ using the refined coal product. Reduced primary combustion air also reduces core flame temperature, reducing thermal NOx formation using the refined coal product. Increasing secondary and/or tertiary combustion air compensates for reduced primary combustion air and result in overall decrease in NOx formation (e.g., thermal NOx formation is reduced when combustion completed in cooler secondary and/or tertiary combustion zones).

24 Claims, 9 Drawing Sheets

METHOD FOR REDUCING AIR FLOW WHEN OPERATING A COAL BURNER

CROSS-REFERENCE TO RELATED APPLICATION

This application is a division of U.S. patent application Ser. No. 12/182,656, filed Jul. 30, 2008, the disclosure of which is incorporated herein in its entirety.

BACKGROUND OF THE INVENTION

1. The Field of the Invention

The present invention relates to a method for reducing NOx emissions during combustion of coal, more particularly to methods that utilize coal that has been cleaned to lower the ash while reducing the ratio of primary combustion air to fuel and compensating for such reduction with increased secondary and/or tertiary (or overfire) air.

2. Related Technology

Coal combustion is a major source of energy for the production of electricity throughout the world. Coal is a good source of energy because of its high energy to weight ratio and its great abundance. The use of coal, however, is increasingly under scrutiny because of environmental concerns. Among the known environmental difficulties with coal combustion is the production and emission of NOx compounds, such as NO, $N_2O$, and $NO_2$. NOx compounds can be very harmful to human health and are known to produce undesirable environmental effects such as smog and acid rain.

Government regulations require emission from coal burning to be monitored and controlled. Controlling NOx emissions has become increasingly important as government regulations continue to lower the allowable level of NOx and other pollutants that can be released into the environment. The requirement for reduced pollutants from coal-fired power plants has led to a demand for suitable new technologies.

In a coal fired power plant, there are two principle sources of NOx formation: fuel NOx and thermal NOx. Fuel NOx is formed from bound or fixed nitrogen contained in the fuel, whereas thermal NOx is formed from non-fuel sources of nitrogen, such as nitrogen contained in the combustion air. About 80% of NOx emissions from coal combustion are produced from fuel nitrogen.

One method used to reduce pollutants during coal combustion focuses on removing NOx from power plant flue gas. For example, NOx emitted in flue gas can be removed using selective catalytic reduction (SCR), which converts NOx compounds to nitrogen gas ($N_2$) and water. However, this type of NOx control method is expensive, in part, because of the required capital investment. The cost of these technologies and increasingly stringent government regulations have created a need for less expensive technologies to reduce NOx emissions from coal combustion.

Another method of reducing NOx emissions is to remove coal nitrogen from the coal material by converting it to $N_2$. Researchers have discovered that iron-based catalysts can assist in releasing fuel nitrogen from coal. Ohtsuka and coworkers at Tohoku University (Sendai, Japan) describe methods for producing an iron-based catalyst which, when combined with coal and placed in an pyrolysis environment, causes nitrogen compounds in coal to be released more rapidly, thus causing a decrease in the amount of nitrogen remaining in the char material (Ohtsuka et al., Energy and Fuels 7 (1993) 1095 and Ohtsuka et al., Energy and Fuels 12 (1998) 1356). Such methods for reducing NOx have been impractical. Ohtsuka precipitates $FeCl_3$ solution directly onto coal using $Ca(OH)_2$, which results in an increase in the ash content (up to 7 wt % iron) and requires washing with water to remove chloride salts, thus also adding water to the coal.

Improvements to the Ohtsuka method are disclosed in U.S. Pat. No. 7,357,903, entitled "METHOD FOR REDUCING NOx DURING COMBUSTION OF COAL IN A BURNER" and assigned to Headwaters Heavy Oil, LLC of South Jordan, Utah. This patent discloses applying a nanoparticle catalyst to coal, either before or after it is pulverized, and then burning the treated coal in the low oxygen zone of a coal burner. Preliminary tests showed that the nanoparticle catalyst was effective in reducing NOx formation, presumably by catalyzing more rapid release of fuel nitrogen from the coal to form $N_2$ in the low oxygen zone before it can combust to form NOx in more oxygen rich zones of the burner.

In general, determining how much NOx a particular coal will produce during combustion can be a very difficult calculation; NOx emissions can be highly variant depending on the combustion temperature, oxygen level, and fuel nitrogen content.

In view of the foregoing, there remains a need to find improved coal treatment and combustion methods for reducing NOx emissions, particularly methods that can utilize a wide range of different types of coal feedstocks having greatly varying quality while reliably reducing NOx emissions compared to conventional methods.

BRIEF SUMMARY OF THE INVENTION

Embodiments of the present invention provides methods for reducing the output of NOx during coal combustion by (1) cleaning an initial coal feedstock to yield a refined coal product having reduced ash content and density, (2) pulverizing the refined coal product, (3) feeding the pulverized refined coal product of lower ash content and density into the primary combustion zone of a coal burner while reducing the amount of primary combustion air used to convey the coal particles in suspended condition, which reduces the air/fuel ratio compared to the minimum amount of primary air required to keep the initial coal feedstock from settling, and (4) compensating for the reduction in primary combustion air by introducing more secondary air and/or tertiary (overfire) air. In many cases the total amount of combustor exit oxygen passing out with the flue gas remains the same (e.g., between about 2-3%) to provide the same total burn efficiency.

Cleaning the coal to reduce its ash content was found to greatly reduce the formation of NOx because coal containing reduced ash yields pulverized coal having significantly lower average particle density. Reducing the particle density of the pulverized coal reduces the quantity of primary combustion air that is required to maintain the pulverized coal in a suspended condition while traveling through the feeder pipes that introduce the coal into the primary combustion zone of the coal burner. Lowering the amount of primary combustion air in turn reduces NOx formation.

To prevent settling of the pulverized coal particles, the primary air velocity must exceed the settling velocity of the coal particles. The settling velocity is a function of the air conditions (e.g., temperature, density, velocity and fluid viscosity) and coal properties (e.g., particle size, density and particle morphology). Providing insufficient air velocity in the pipes results in settling out of the heavier particulate fractions. This temporarily increases the velocity of the air at the point of coal lay-down. When enough of the coal has settled out, the air velocity becomes high enough to pick up the laid-out coal, causing a slug of fuel to suddenly exit the pipe and enter the burner, which causes flame instabilities and less efficient combustion. For any given type of coal, there will generally be a minimum air velocity that is required to prevent settling out. Variations in the quality of coal can create variations in the amount of air required to keep the pulverized coal in suspension, thus requiring either constant adjustment or excess primary combustion air to maintain the pulverized coal in suspension in spite of fluctuating coal quality. Cleaning coal to reduce its ash content and particle density allows for a significant reduction of primary combustion air. It also improves the consistency of the coal, which permits the coal burner to be operated with a lower minimum primary air velocity required to prevent settling.

Reducing the amount of primary combustion air reduces NOx formation by reducing the ratio of oxygen to fuel in the primary burn zone, particularly the core of the flame. NOx is formed mainly from the nitrogen in the fuel (approximately 80%) rather than nitrogen in the air (except under more extreme burn conditions, such as are found in magnetohydrodynamic systems, slagging combustors and cyclone barrels). As fuel nitrogen is released from the coal particles during combustion, if there is sufficient available oxygen, the nitrogen will typically react with the oxygen to form NOx. However, if there is insufficient available oxygen (i.e., because it is being consumed in the main combustion reactions involving elemental solid carbon and volatile hydrocarbons), the nitrogen will instead typically react with carbon and hydrogen atoms to form $CN^-$ and $NH^-$ radicals. These further react with oxygen when present to form mainly $N_2$ rather than NOx.

The oxygen deficit that results from reducing the quantity of primary combustion air introduced into the primary combustion zone may be compensated for by increasing the quantity of secondary and/or tertiary air in order to complete combustion. One way that reducing primary air reduces NOx formation is described above (i.e., substantially more of the fuel nitrogen is converted into inert $N_2$ gas rather than NOx). Another way is that reducing primary are reduces the flame temperature, which reduces thermal NOx formation (i.e., NOx formed as a result of the thermally induced reaction between $N_2$ and $O_2$ in the combustion air, which is reduced with decreasing temperature). An advantage of increasing secondary and/or tertiary combustion air is that the secondary and tertiary combustion zones are significantly cooler than the primary combustion zone by several hundred degrees, which further reduces thermal NOx formation when completing combustion of the fuel.

The ash content of coal can be reduced using mineral processing techniques known in the art. High ash run-of-mine coal or waste coal recovered from impoundments and piles can be upgraded to cleaner burning low ash coal utilizing dry jigging and/or wet processing to separate rock, clays and other inert mineral impurities from the waste coal and convert it into a higher value refined coal product. In addition to reducing the sulfur and mercury present in the feedstock mineral component, the refined coal exhibits cleaner burn characteristics relative to NOx emissions as compared to the initial coal feedstock.

The regulation of NOx emissions for coal-fired burners is often performed using continuous emissions monitors in the exhaust stack. However, the use of a commercial burner as a test bed to establish emissions reductions is impractical. Pilot plants can be highly representative of commercial coal burners when care is taken to simulate the turbulent mixing and length scales that are generated in practice in a commercial burner. The initial dirty coal feedstock and refined coal testing materials are advantageously pulverized to typical power plant specifications of 70% passing through a 200 mesh screen (74 microns) and at least 99% passing through a 50 mesh screen (297 microns). The relevant operating parameters include primary/secondary air temperatures and velocities, secondary air swirl, air/fuel ratio, air distribution amongst the air streams (including primary air, secondary air, and air separated from the burner), and residence time/gas temperature relationship. In comparing NOx emissions of an initial coal feedstock to that of the refined coal product, particular attention can be given to the amount of primary air. In practice, this parameter can vary substantially based on the fuel properties (e.g., heating value, moisture content, and ash content). When reducing NOx is a high priority, the primary air to coal ratio is typically kept as low as is practicably possible. Therefore, during comparative testing, this ratio should be held at a value representative of a commercially realistic, but low, level for the high ash feedstock in order accurately assess the reduction in NOx formation when using the lower ash refined coal.

It is currently believed, based on pilot scale testing, that reducing the ash content of a relatively dirty coal feedstock from approximately 30-40% by weight to less than 15% can result in NOx reductions of over 20% and as high as 50%. According to one embodiment, the dry basis ash content of an initial coal feedstock is reduced by at least about 20% to yield the refined coal product that is introduced into the coal burner using less primary combustion air to reduce NOx emissions. According to another embodiment, the dry basis ash content of an initial coal feedstock is reduced by at least about 30% to yield the refined coal product. According to yet another embodiment, the dry basis ash content of the initial coal feedstock is reduced by at least about 40% to yield the refined coal product. The dry basis ash content of the initial coal feedstock can be reduced by as much as about 60% or more for secondary coal feedstocks that are considered to be waste, low value and/or non-usable coal.

Reducing the dry basis ash content of one primary coal feedstock from 15.9% to 8.5%, for a net dry basis ash reduction of approximately 45%, and reducing the primary combustion air by 10% was found to reduce NOx emissions by about 31%. Reducing the dry basis ash content of the secondary coal feedstock at the same location from 48.2% to 14.9% (a net dry basis ash reduction of approximately 70%) and reducing the primary combustion air by 10% was found to reduce NOx emissions by about 54%. From the foregoing, it will be appreciated that the coal cleaning and primary air reduction techniques of the invention work for both primary and secondary coal feedstocks, although the greatest NOx reductions appear to be achievable when employing the inventive methods using secondary coal feedstocks. Demonstrating such NOx reductions in the case of secondary or waste coal feedstocks may increase the economic value of such feedstocks, which are often not used but allowed to pile up in the environment.

These and other advantages and features of the present invention will become more fully apparent from the following description and appended claims as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF EXEMPLARY EMBODIMENTS

I. Introduction

Figure 1:
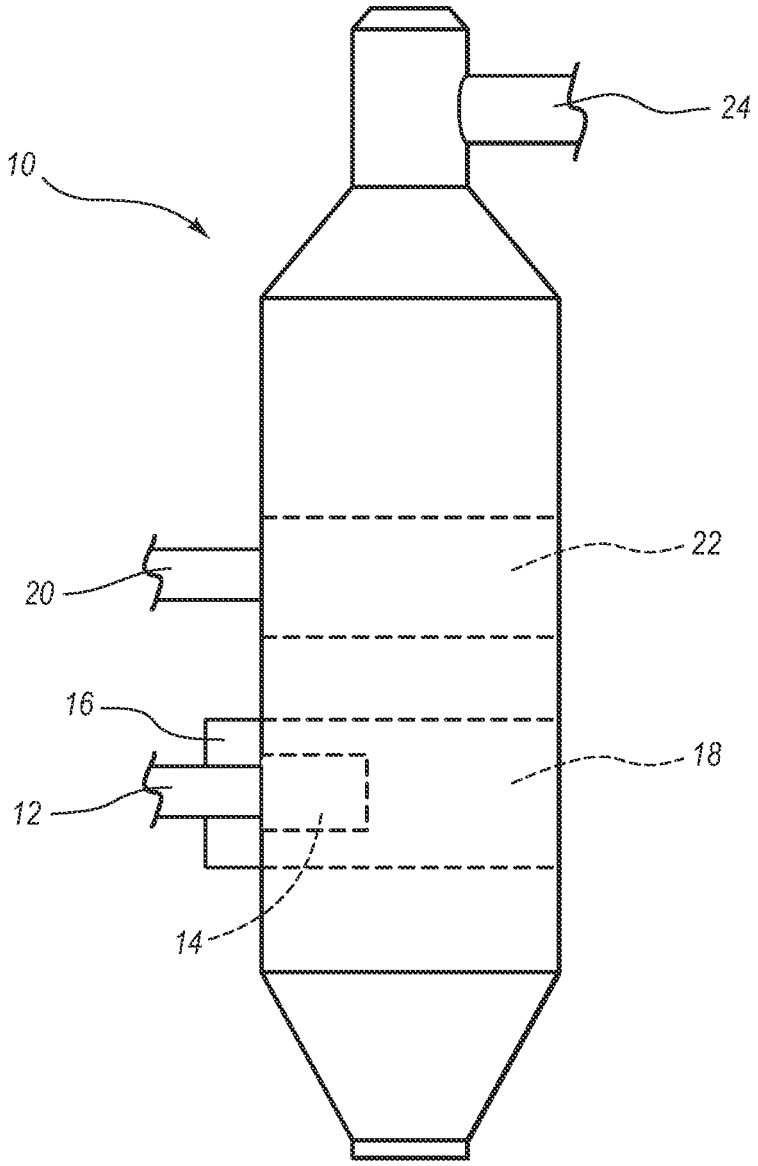
FIG. 1 is a schematic diagram of a coal burner having multiple combustion zones and multiple ports for introducing combustion air into the combustion zones.

Embodiments of the invention relate to methods for reducing NOx emissions which involve reducing the ash content of a coal feedstock, which yield a refined coal product having a lower specific gravity, and then reducing the amount of primary combustion air required to convey pulverized refined coal particles into the primary combustion zone of a coal burner while maintaining the coal particles in a suspended condition and preventing settling within the feeder pipers. Reducing the amount of primary combustion air required to convey the refined coal particles into the primary combustion zone reduces the air/fuel ratio, reduces the core flame temperature, reduces the amount of oxygen available to form NOx from fuel nitrogen, and reduces production of thermal NOx. An increased amount of secondary and/or tertiary (or overfire) air can be added to the coal burner to offset the reduction in primary combustion air and maintain a desired oxygen level within the flue gas exiting the coal burner.

The terms "primary coal feedstock" and "primary material" refer to higher quality coal feedstocks having lower ash content (e.g., less than 25% by weight (dry basis) ash, typically less than about 20%, more typically less than about 15%, and ideally about 10% or less for bituminous and sub-bituminous coals).

The terms "secondary coal feedstock" and "secondary material" refer to lower quality coal feedstocks having higher ash content (e.g., greater than about 25% by weight (dry basis) ash, typically greater than about 30%, often greater than about 35%, and sometimes as high as about 40% or greater).

The term "NOx" mainly refers to the three common stable nitrogen oxide species known as nitric oxide (NO), also known as nitrogen (II) oxide; nitrogen dioxide ($NO_2$), also known as nitrogen (IV) oxide; and nitrous oxide ($N_2O$), also known as nitrogen (I) oxide. NOx also refers to the following unstable nitrogen oxide species, which are converted into one or more stable species: dinitrogen trioxide ($N_2O_3$), also known as nitrogen (II, IV) oxide, dinitrogen tetroxide ($N_2O_4$), also known as nitrogen (IV) oxide, and dinitrogen pentoxide ($N_2O_5$), also known as nitrogen (V) oxide. NOx molecules can react with oxygen and water to form nitric acid, a component of acid rain.

The term "primary combustion air" refers to the air that is introduced directly into the primary combustion zone of a coal burner together with the pulverized coal fuel. It is typically used to convey the pulverized coal particles through the feeder pipes at a velocity that exceeds the settling velocity of the coal particle material.

The term "primary combustion zone" refers to the region of a coal burner where the coal is introduced and first caused to undergo combustion. It includes the core of the flame, which is very fuel rich and includes insufficient oxygen for complete combustion. The hottest part of the flame is the boundary between the primary and secondary combustion zones where the fuel begins to be exposed to sufficient oxygen to begin complete combustion. By way of example, the temperature at the boundary between the primary and secondary combustion zones can be about 2900° F. (about 1600° C.).

The term "secondary combustion air" refers to the air that is introduced around (e.g., above and below) the primary combustion air into the secondary combustion zone of the coal burner. It is typically introduced in a swirling fashion to enhance mixing of the burning coal particles from the primary combustion zone with the secondary combustion air. This, in turn, enhances combustion efficiency of the burning coal particles.

The term "secondary combustion zone" refers to the region of a coal burner surrounding (e.g., above and below) the primary combustion zone where the coal continues to combust after first being ignited in the primary combustion zone. It is typically the second hottest region of the coal burner but is significantly cooler than the boundary between the primary and secondary combustion zones. By way of example, the temperature within the secondary combustion zone can be about 2700° F. (about 1500° C.).

The terms "tertiary combustion air" and "overfire air" refer to air that is introduced in the tertiary combustion region above the primary and secondary combustion zones. This air helps to complete combustion of the coal fuel in the burner.

The term "tertiary combustion zone" is the region of a coal burner above the primary and secondary combustion zones and below the constricted portion of the burner. It is typically the third hottest region of the coal burner but is significantly cooler than the secondary combustion zone. By way of example, the temperature within the tertiary combustion zone can be about 2300° F. (about 1250° C.).

The term "primary air/fuel ratio" refers to the mass of air used to convey a given mass of pulverized coal fuel from the mill to the coal burner.

The term "ash content" refers to the percentage by dry basis weight of the coal feedstock that is ash (e.g., non-combustible materials such as rock, dirt, clay and other inert inorganic impurities).

The terms "minimum conveyance velocity" and "minimum velocity" refer to the baseline primary combustion air flow velocity required to maintain the pulverized coal particles in a suspended condition without particle settling within the feeder pipes.

The term "settling velocity" refers to the velocity of air flow at which pulverized coal particles begin to settle out within the feeder pipes.

In one exemplary method, NOx emissions are reduced during the combustion of coal by (1) cleaning a primary or secondary coal feedstock to yield a refined coal product having reduced ash content and density, (2) pulverizing the refined coal product, (3) feeding the pulverized refined coal into the primary combustion zone of a coal burner with a reduced amount of primary combustion air and lower air/fuel ratio due to the reduced particle density of the refined coal product compared to the feedstock, and (4) introducing more secondary air, tertiary air and/or overfire air to compensate for the reduction in primary combustion air by. The result is substantially lower NOx emissions compared to burning the coal feedstock, with NOx reductions of at least about 20% and up to 50% or more in some cases.

II. Exemplary Coal Cleaning Techniques

The ash content of coal can be reduced using coal cleaning techniques known in the art. High ash run-of-mine coal or waste coal recovered from impoundments and gob piles can be upgraded to cleaner burning low ash coal utilizing dry jigging and wet processing to separate rock, clays and other inert mineral impurities from the waste coal and convert it into a higher value refined coal product. In addition to reducing the sulfur and mercury present in the feedstock mineral component, the refined coal exhibits cleaner burn characteristics relative to NOx emissions as compared to the initial coal feedstock.

A. Dry Jigging

"Dry jigging" refers to coal processing techniques in which air is used to separate the lower density coal fraction from the higher density inorganic ash fraction. Exemplary dry jigging methods are described in U.S. Pat. No. 6,467,631 to Stangalies et al., which is assigned to allmineral LLC, the disclosure of which is incorporated herein by reference in order to disclose dry jigging methods for cleaning coal. Dry jigging works best with dry coal found mainly in drier climates and regions.

In Stangalies et al., an air sifting apparatus is provided for refining a coal feedstock, and includes a material feed-in device, a material bed support device, an air jig plenum, and a discharge control device. The material bed support device receives material from the material feed-in device and has a surface with a plurality of openings for introducing air from underneath the material bed support device, which is operable to transport solid material in coordination with the flow of air through the openings to effect loosening and stratification of the material into a layer of relatively heavier material (i.e., inorganic ash components), and a layer of relatively lighter material (i.e., coal) on top of the heavier material. The air jig plenum communicates with the underside of the apparatus for guiding air thereto and produces constant air flow through the openings of the support device and a pulsating air flow, overlaid on the constant air flow, for pulse impacting material on the support device. The discharge control device controls discharge of solid material from the support device. The lighter material is directed to one location and the heavier material is directed to another location.

B. Wet Coal Cleaning

Wet coal cleaning processes are useful for cleaning low value waste coal separated in previous mining operations and discarded and accumulated into gob piles, settling ponds and other impoundments in which the waste coal is too wet to be processed by dry jigging. Coal fines in need of cleaning may comprise discarded material from coal mining that has been previously processed by conventional commercial washing. These coal fines are generally a mixture of inorganic mineral contaminants and low-ash coal particles smaller than 6 mm. Due to the conditions in the fines impoundment, coal particles are typically coated with high-ash clay particles, which must be scoured from the surface of the coal to produce refined material of marketable quality.

The refining process can be engineered to match the characteristics of the each individual deposit. Key parameters include the particle size distribution of the fines, the density distribution of the fines, and the surface chemistry of the fines. Physical density separation technology may be used for particles smaller than 6 mm but larger than 0.10 mm. Surface chemistry processes may be used for particle sizes smaller than 0.30 mm. Hydraulic separation may be used for particles smaller than 0.15 mm. In addition, particles larger than 0.15 mm may be separated using two distinct gravity separation processes. Particles between 1 mm and 0.15 mm may be separated using a thin-film density separator (or concentrating spiral). Particles larger than 1 mm may be separated using a modified hindered settling process such as a teeter-bed separator or Baum jig separator, which rely on differences in particle densities that cause the denser particles to settle quicker than the lighter particles and form a barrier which prevents the lighter particles from penetrating the denser particle bed and commingling with the denser particles.

In one embodiment, coal fines are hydraulically mined using a dredge or removed using an excavator. This mined material is sent to a plant for preparation, slime removal, chemical treatment, size classification, ash separation, dewatering and preparation for transport. Waste material removed from the deposit is transported in slurry form through a trash screen to remove large debris, such as rocks and plant limbs, to a surge tank for homogenization and attrition. The slurry pump out of the surge tank provides some attrition and is followed with additional attrition as it passes through subsequent processing pumps. Slurry from the surge tank pump is delivered to a scalping sieve and screen (deslime screen) for initial size classification where particles larger than 1 mm are segregated for separate processing.

Slurry containing particles finer than 1 mm flows from the scalping sieve and screen into a specially designed process tank (deslime tank) that serves a three-fold purpose: (1) provide a large surge volume to level-out fluctuations in the instantaneous volume of material delivered from the dredge to the plant; (2) classify the feed slurry at 0.045 mm to remove fine, high-ash slimes from the process feed; and (3) provide controlled sedimentation to increase and homogenize the solids content of the feed. The concentrated slurry is delivered by centrifugal pump to the separation processes as a consistent, de-slimed feed. Maintaining consistent feed quality achieves the most efficient processing of the coal fines. The centrifugal pump provides additional attrition scrubbing to remove additional adhering high-ash particles from the coal.

A final attrition scrubbing step may be provided by the pump feeding the classifying cyclones. This pump delivers the homogenized feed slurry to hydraulic cyclones that separate the slurry into a stream of 1 mm×0.15 mm particles, and a stream of 0.15 mm×0.045 mm particles. The larger particles are processed with spiral concentrators (coal spirals), and the finer particles are processed using froth flotation, a surface chemistry separation technology. The spiral concentrators have a helical geometry and are hydraulic, thin-film separators that employ low-g centrifugal separation to separate particles by mass and density. The centrifugal action forces lower density fuel particles to the outer perimeter of the helix while the denser mineral particles remain at the inner perimeter. Spiral concentrators are especially effective for removal of heavy minerals such as pyrite.

Froth flotation separation takes place in the floatation cells and is based upon surface chemistry differences in fuel and mineral matter. This makes it advantageous to incorporate attrition scrubbing into the process to remove inorganic mineral particles from the surface of the organic fuel particles prior to separation. The first step in froth flotation is "conditioning" and involves application of a liquid hydrocarbon such as diesel fuel or kerosene to the fuel particle surfaces. Mineral matter is inorganic and generally hydrophilic; coal particles are hydrophobic so the hydrocarbon attaches to the coal particles, creating an extremely hydrophobic surface film on the coal particles.

In the second stage, alcohol is added to the feed slurry. The alcohol molecules attach themselves preferentially to the hydrocarbon film. Alcohol has a high affinity for air so that, when fine air bubbles are introduced into the slurry, they can attach to the alcohol and float the coal particles to the surface of the separation tank where they can be skimmed off. Mineral particles remain with the bulk of the slurry and are discharged from the bottom of the tank.

Clean fuel from the spiral concentrators and froth flotation cells are combined in the screen bowl centrifuge head box for further processing, which removes excess water and residual clays in a two-step process. First, most of the water and residual clay are decanted from the feed slurry. Second, residual water is removed from the fuel, resulting in a low-moisture, low-ash fuel with good handling characteristics.

Overall plant control may be accomplished by a programmable logic control ("PLC") system. Pumps, slurry densities, chemical addition, and plant flows may be monitored and controlled using digital inputs and outputs from the plant PLC. Final product quality is monitored by an ash analyzer. Using the feedback from the ash analyzer, the plant processing equipment can be controlled to provide a specific product quality in accordance with the targeted quality specification. Specifically targeting a product quality requirement improves plant efficiency by allowing the plant to maximize recovery while achieving quality requirements.

Profound physical, chemical, and fuel quality changes occur in the processed coal fines. Waste coal fines are very high in moisture and mineral matter, low in energy content, and also contain high levels of mercury and other elements such as lead, selenium, and arsenic. Physically, the coal fines are present in a form ranging from a thick sludge to a dilute slurry. The cleaning process can increases the BTU value of the fuel ten-fold and reduce its mineral matter and moisture by more than 80% and the mercury content by about 50%. Some of the sulfur and the trace elements associated with the mineral matter may also be removed. The hydrogen and carbon content of the fuel product is greatly concentrated compared to the waste coal fines. Physically, the product is a dry, flowable powder. The reduction of water and mineral matter in the fuel as compared to the feedstock translate to much more efficient combustion in the boiler due to the fact that energy is not required to heat these impurities to the >2500° F. temperature in the coal burner.

An analysis of the differences between one type of feedstock coal and the refined coal as a result of the wet cleaning process provided the following results:

| | Feed | Product | Improvement |
|---|---|---|---|
| Ash (lb/MBTU) | 42.4 | 10.8 | 74.4% |
| Sulfur (lb/MBTU) | 0.96 | 0.83 | 13.2% |
| Moisture (lb/MBTU) | 327.26 | 10.15 | 96.9% |
| BTU/lb | 2,292 | 11,824 | 416% |
| Arsenic (lb/MBTU) | 7 | 3 | 70.8% |
| Lead (lb/MBTU) | 18 | 10 | 62.1% |
| Mercury (lb/MBTU) | 0.04 | 0.02 | 65.9% |
| Cadmium (lb/MBTU) | 0.80 | 0.30 | 74.4% |

III. Refined Coal Products

The reduced ash quantity of the refined coal products reduces the non-combustible material entering the boiler or other coal burner. This permits the combustible portion of the coal to be heated more rapidly and allows the flame to become more strongly attached to the burner face. This reduces the pulsation of the flame and makes it more stable. This increased stability also permits more of the coal nitrogen to evolve within the fuel-rich central core where there is a deficiency of oxygen (as compared to the later stages of the flame) where the oxygen has mixed with the fuel.

The reduction of ash quantity reduces the heaviest components of the ash, such as iron. This reduction in the heavy ash constituents reduces the individual ash particle density, which requires less air to maintain a particle in suspension; that is, the settling velocity is decreased. The other advantage is that the heavier ash components such as iron, which constitute the harder fraction of the particle, are removed making the refined coal particles "softer". This increase in Hargrove Grindability allows the pulverizer to grind the coal finer, which further reduces the amount of air needed to keep the smaller particles in suspension.

In general, it is advantageous to reduce the amount of ash from the coal feedstock material by at least about 20% by dry basis weight. The economic feasibility of removing ash from a particular coal feedstock may depend on the quality and ash content of the feedstock material. In general, greater benefits in terms of NOx reduction can be realized for coal feedstocks having a higher ash content. That is because burning dirtier coal generally requires a much higher air/fuel ratio owing to the greater difficulty in maintaining efficient combustion and flame stability when the coal contains more ash. In general, it may be preferable to reduce the ash content of the coal feedstock by at least about 30% by dry basis weight, more preferably preferably by at least about 40% by dry basis weight, and even more preferably by at least about 50% by dry basis weight, and most preferably by at least about 60% by dry basis weight, particularly where the initial coal feedstock contains a relatively high level of ash (e.g., 40%).

Conversely, the refined coal product will have a reduced ash content relative to the initial ash content of the feedstock material. According to one embodiment, the refined coal product will have an ash content less than about 80% of the initial ash content of the feedstock material, preferably less than about 70% of the initial ash content of the feedstock material, more preferably less than about 60% of the initial ash content of the feedstock material, even more preferably less than about 50% of the initial ash content of the feedstock material, and most preferably less than about 40% of the initial ash content of the feedstock material.

In absolute terms, for primary coal feedstocks having an initial ash content of less than 25% by dry basis weight, the ash content is typically reduced to less than about 15% by dry basis weight, preferably to less than about 12% by dry basis weight, more preferably to less than about 10% by dry basis weight, and most preferably to less than about 8% by dry basis weight. For secondary coal feedstocks having an initial ash content greater than about 25% (e.g., 30-50%), the ash content is typically reduced to less than about 20% by dry basis weight, preferably to less than about 17.5% by dry basis weight. more preferably to less than about 15% by dry basis weight, and most preferably to less than about 12.5% by dry basis weight.

The refined coal product will also typically contain reduced quantities of mercury and/or sulfur compared to the initial coal feedstock material. In general, the quantity of mercury and sulfur in a coal material directly relate to the amount of mercury and sulfur that is/are emitted from the coal burner. That is because mercury and sulfur are not found in the air and therefore can only be generated when contained in the fuel being burned. Mercury is generally found in greater quantities where the coal feedstock contains more ash, although the mercury content can also vary depending on the chemical composition of the ash. In general, the coal cleaning methods employed herein will typically reduce the quantity of mercury in the initial feedstock by at least about 20% by dry basis weight, preferably at least about 30% by dry basis weight, more preferably at least about 40% by dry basis weight, and most preferably at least about 50% by dry basis weight.

In the case where the ash in the initial coal feedstock contains significant quantities of sulfur, the coal cleaning methods employed herein will typically reduce the quantity of sulfur in the initial feedstock by at least about 2% by dry basis weight, preferably at least about 5% by dry basis weight, and more preferably at least about 10% by dry basis weight. Where the sulfur is contained in the coal itself rather than or in addition to the ash, the coal cleaning technique may be adapted to chemically strip sulfur from the coal.

IV. Optimizing Combustion Air when Burning Refined Coal Products in Coal Burner to Reduce NOx Emissions An exemplary coal burner 10 is schematically illustrated in FIG. 1, which includes one or more feeder pipes 12 through which pulverized coal particles and primary combustion air are conveyed to the primary combustion zone 14. Coal burner 10 includes a secondary conduit 16 for introducing secondary combustion air into the secondary combustion zone 18 surrounding the primary combustion zone 14 and a tertiary conduit 20 for introducing tertiary combustion air (or overfire air) into the tertiary combustion zone 22 located above the primary combustion zone 14 and secondary combustion zone 18 and below constricted portion 24, which increases pressure within the combustion zones and accelerates the flue gases as they pass through the constricted portion 24. The core of the flame is located in the primary combustion zone 14. The boundary between the primary combustion zone 14 and secondary combustion zone 18 has the hottest temperature in the coal burner 10 (e.g., 2900° F.). The secondary combustion zone 18 has the second hottest temperature (e.g., 2700° F.) and the tertiary combustion zone 22 has the third hottest temperature (e.g., 2300° F.). The coal cleaning and coal burner optimization methods of the invention reduce NOx formation by reducing the density of the pulverized coal particles and adjusting the relative quantities of primary, secondary and/or tertiary combustion air.

In general, the amount of air used in a coal burner is typically determined based on four conditions: 1) the amount of coal in the burner pipe; 2) the minimum velocity to prevent flame flashback; 3) the settling velocity of pulverized coal; and 4) the quality of the fuel. Each of these are important to optimize mixing of the air and fuel and ultimately the combustion in the furnace.

The distribution of coal from a pulverizer or mill is designed to provide equal flow into all the pipes exiting the mill going to individual burners. This is usually based on trying to balance the pressure drop between all the individual pipes from the pulverizer to the burners. The size of the piping is therefore determined based on the original coal quality provided at the time of the boiler design. As different fuels are used, the fuel flow must remain within individual boiler specifications so that flame detachment and flame flashback do not occur.

There is a minimum velocity in the coal air pipe that is established by individual utilities; however usually this velocity is between about 3300 and 3600 ft/min. Below the minimum velocity there is a chance that the flame may propagate backwards and ignite in the pulverizer and cause an explosion. The coal/air velocity is kept as low as possible to avoid the flame becoming detached at the burner exit. When this occurs, the flame becomes unstable and the flame detectors may not "see" a flame and may call for a burner shut down even though the flame is located off the burner face.

To prevent settling of the pulverized coal particles, the primary air velocity must exceed the settling velocity of the coal particles. The settling velocity is a function of the air conditions (e.g., temperature, density, velocity and fluid viscosity) and coal properties (e.g., particle size, density and particle morphology). It is defined by the following equation:

$$u_t=[4*g*D_p*(\rho_p-\rho)/3*\rho C]^{0.5}$$

where g=gravity constant, $D_p$=particle diameter, $\rho_p$=particle density, ρ=air density, C is a function of the Reynolds (Re) number (for spherical particles with 1000<Re<200,000, C=0.44) and $u_t$ is the settling velocity.

Providing insufficient air velocity in the feeder pipes can result in settling out of the coal particles, which temporarily increases the velocity of the air at the point of coal lay-down. When enough coal has settled out, the air velocity becomes sufficiently high to pick up the laid-out coal, which forces a slug of fuel to suddenly exit the pipe and enter the burner, which causes flame instabilities and less efficient combustion. For any given type of coal, there will generally be a minimum air velocity that is required to prevent settling out. Variations in the quality of coal can create variations in the amount of air required to keep the pulverized coal in suspension, thus requiring either constant adjustment or excess primary combustion air to maintain the pulverized coal in suspension in spite of fluctuating coal quality. Refining coal to reduce its ash content and particle density allows for a significant reduction of primary combustion air. It also improves the consistency of the coal, which permits the coal burner to be operated with a minimum required primary air velocity that is closer to the settling velocity. Coal refining also permits what is typically considered to be waste or unusable coal to be used as a valuable fuel source without greatly increasing NOx emissions, as typically occurs when waste coal is used in a coal burner.

Based on a specific coal quality, the size of the coal piping is determined. This is based on the number of burners desired and the size of the boiler. When the fuel quality changes, alterations can be made to the air flow while maintaining the required safe minimum velocity. For example, processing eastern coals reduces the ash content, iron content of the ash and usually the moisture content—especially using dry coal processing equipment. These changes in coal quality directly reduce the particle density, the particle size and quantity of ash entering the pulverizer and the burner. Therefore as these changes occur, the amount of air required to keep the pulverized product in suspension is reduced. It is this principle that is employed in the disclosed coal upgrading and burner optimization processes.

Figure 2:
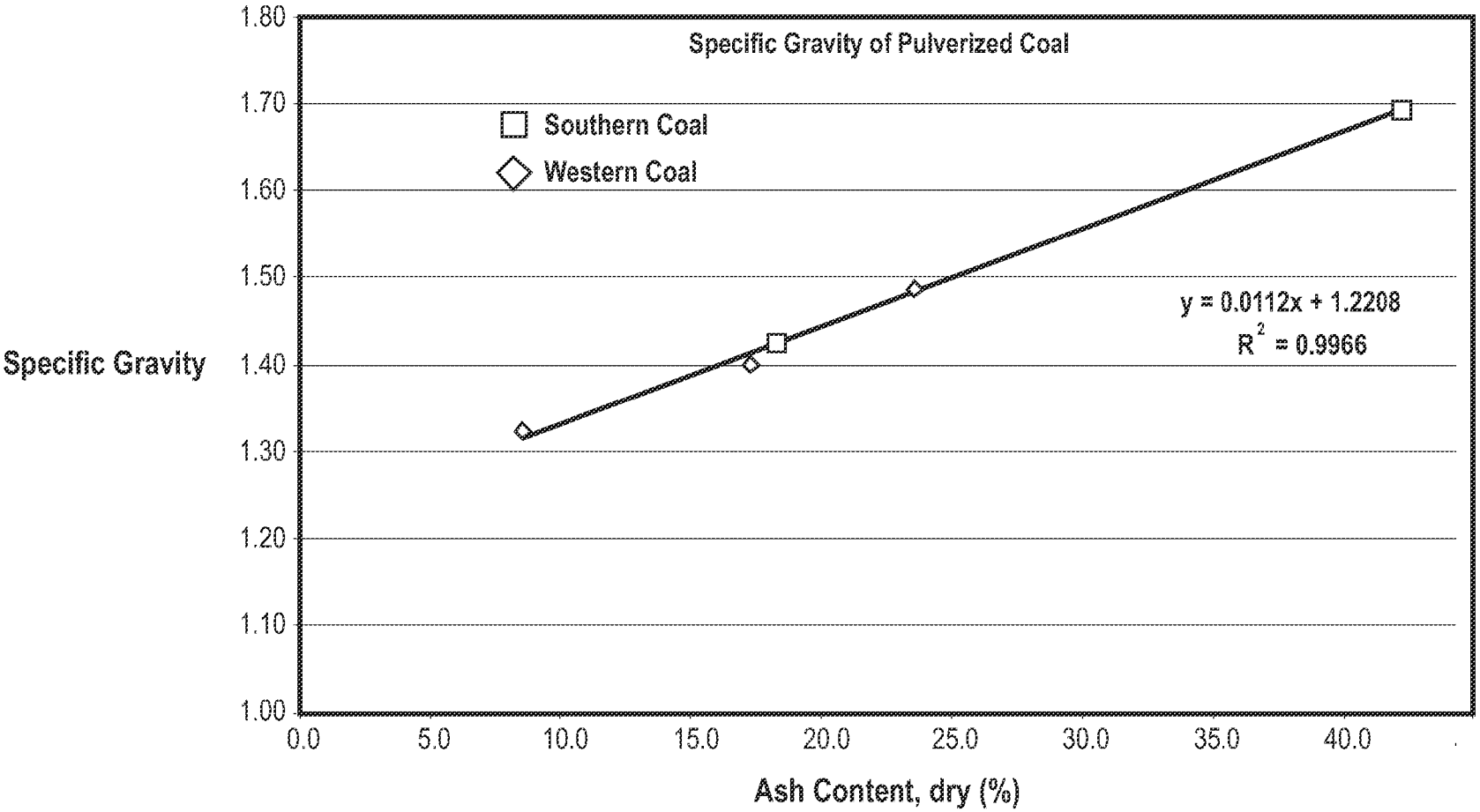
FIG. 2 is a chart that graphically depicts the relationship between the specific gravity of coal and ash content.

The relationship between ash content and the specific gravity of pulverized coal is graphically illustrated in FIG. 2. Two types of coal were used to construct the relationship shown in FIG. 2: western coal, which tends to be much drier, and southern coal, which tends to contain substantially more moisture. On a dry basis, the ash content will typically correlate well with specific gravity, or density, of the pulverized coal material.

Reducing the particle density of the pulverized coal reduces the quantity of primary combustion air required to convey the pulverized coal through the feeder pipes or lines in a suspended condition into the primary combustion zone of the coal burner. That is because particles of reduced density have a lower settling velocity (i.e., they can travel more slowly through the feeder line without settling). Reducing the quantity of air required to convey the coal particles in a suspended condition reduces its velocity and reduces the air/fuel ratio. Lowering the air/fuel ratio in the primary combustion air reduces NOx formation in at least two ways. NOx emissions are primarily reduced by reducing or eliminating oxygen that would otherwise be available to react with fuel nitrogen to form NOx. By providing a flame core in the primary combustion zone that is oxygen deficient, more of the fuel nitrogen is converted into inert nitrogen gas instead of NOx. Second, reducing the amount of oxygen in the primary combustion zone lowers the temperature at the core of the flame, which reduces the amount of thermal NOx that is formed as a result of the thermally induced reaction of nitrogen and oxygen.

The most important of the two sources of NOx reduction is reducing the quantity of NOx formed from fuel nitrogen, which typically represents approximately 80% of the NOx emissions, except in the case of extreme burn conditions, such as are found in magnetohydrodynamic systems, slagging combustors and cyclone barrels. Providing an oxygen deficit in the primary combustion zone causes the nitrogen to react with carbon and hydrogen atoms to form $CN^-$ and $NH^-$ radicals, which further react when oxygen in the secondary and/or tertiary combustion zones to form mainly $N_2$ rather than NOx.

Since the particle density is so much larger than the air density, the settling velocity varies with the square root of the particle density. Using the data from FIG. 2, when the ash content is reduced from 40% to 10%, the particle density decreases by about 20% and the corresponding settling velocity, all other conditions being the same, drops by about 10%, This means that the primary air/fuel ratio used with upgraded coal products can be reduced by this or other corresponding amount depending on the ash reduction and still maintain sufficient air flow and buoyancy to maintain the pulverized coal particles in a suspended condition in the coal/air line (or feeder pipes) from the mill to the burner.

FIGS. 3-9 demonstrate how cleaning coal feedstocks to reduce their ash content results in a refined fuel product that can be safely operated at lower air/fuel ratios. This in turn results in lower NOx emissions. The greatest reductions in NOx emissions as between the feedstock and refined product are typically achieved when dirtier coal feedstocks having a high initial ash content are cleaned to reduce ash by at least about 50% by dry basis weight.

In general, it will be advantageous to reduce the quantity of primary combustion air (and air/fuel ratio) by at least about 5% compared to the quantity of primary combustion air (and air/fuel ratio) that must typically be used to achieve the same level of particle suspension and flame quality in the coal burner when using the initial coal feedstock, preferably by at least about 10%, and more preferably by at least about 15%. According to one embodiment, the air/fuel ratio is preferably less than about 2, more preferably less than about 1.8, and most preferably less than about 1.6. The air/fuel ratio is measured using a calibrated v-cone (calibrated against a dry gas meter) for the air flow and a gravimetric weight-loss feeder for the coal feed. Using the measured air flow, air temperature and pipe size, the mass of air is calculated and is divided by the mass of coal fed to give the air/fuel ratio on a mass/mass basis.

The oxygen deficit that results from reducing the quantity of primary combustion air introduced into the primary combustion zone can be compensated for by increasing the quantity of secondary, tertiary and/or overfire air in order to complete combustion. An advantage of increasing secondary, tertiary and/or overfire combustion air is that these other combustion zones are significantly cooler than the primary combustion zone by several hundred degrees, which further reduces thermal NOx formation when completing combustion of the fuel. According to one embodiment, the amount of secondary and/or tertiary air is/are increased in order to result in a combustor exit oxygen level of at least about 1%, preferably at least about 2%, and most preferably between about 2-3%.

It is currently believed, based on pilot scale testing, that reducing the ash content of a relatively dirty coal feedstock from approximately 30-40% by weight to less than 15% can result in NOx reductions of over 20% and as high as 50%. In general, the methods of the invention will preferably reduce NOx emissions when burning the refined coal product by at least about 20% compared with NOx emissions when burning the feedstock coal material, more preferably by at least about 35%, and most preferably by at least about 50%, as measured by NOx lbs/MMBTU.

The methods of the invention will also reduce mercury emissions when burning the refined coal product by at least about 30% compared with mercury emissions when burning the coal feedstock material, more preferably by at least about 40%, and most preferably by at least about 50%. The methods of the invention may also, in some cases, reduce sulfur emissions when burning the refined coal product by at least about 2% compared with sulfur emissions when burning the coal feedstock material, more preferably by at least about 5%, and most preferably by at least about 10%.

From the foregoing, it will be appreciated that the coal cleaning and primary air reduction techniques of the invention work for both primary and secondary coal feedstocks, although the greatest possible NOx reductions appear to be possible when employing the inventive methods using secondary coal feedstocks. Demonstrating such NOx reductions in the case of secondary or waste coal feedstocks may increase the economic value of such feedstocks, which are often not used but allowed to pile up in the environment.

V. Predicting NOx Emission Reductions for a Refined Coal Product

Although fuel properties, such as fuel nitrogen content and volatility, play an important role in determining NOx emissions, a simple fuel-based analysis is not an accurate predictor of NOx emissions when coal is burned. The specific combustion equipment used when burning coal has a significant impact on NOx emissions. The regulation of NOx emissions for coal-fired boilers in the U.S. is most often performed based upon continuous emissions monitors in the exhaust stack. However, the use of a commercial burner as a test bed to establish emissions reductions may be impractical.

The use of pilot-scale combustion test facilities provides an alternative to full-scale testing and can be applied by combustion equipment manufacturers, power generation companies, government agencies and universities to estimate the NOx emissions produced by specific fuels. The advantages of using pilot-scale combustion furnaces to evaluate combustion performance include the following: operating parameters can be closely monitored and controlled, sampling and gas analysis can be performed in a more controlled environment using equipment that does not have to be field-hardened or portable, and far less fuel is required.

NOx emissions from pilot-scale tests can be highly representative of commercial boilers when care is taken to simulate the design and operating parameters of the boiler. In this situation, it is important to simulate the turbulent mixing and length scales that are generated in practice. The initial coal feedstock and refined coal test materials are advantageously pulverized to typical power plant specifications of 70% passing through a 200 mesh screen (74 microns) and at least 99% passing through a 50 mesh screen (297 microns). The pulverized materials are then analyzed for characterization.

Pilot-scale combustion facilities should be operated to simulate the conditions of commercial boilers. Relevant operating parameters include primary/secondary air temperatures and velocities, secondary air swirl, air/fuel ratio, air distribution amongst the air streams (including primary air, secondary air, and air separated from the burner), and residence time/gas temperature relationship. In practice, there is variation in these parameters depending upon factors such as combustion equipment tendencies, plant economics, fuel properties, and specific regulatory priorities. In order for the combustion testing and emissions comparisons to be valid, "typical" values must be identified for each of these parameters. In comparing NOx emissions of an initial coal feedstock to that of the refined coal product, particular attention can be given to the amount of primary air. In practice, this parameter can vary substantially based on the fuel properties (e.g., heating value, moisture content, and ash content). When reducing NOx is a high priority, the primary air to coal ratio is typically kept as low as is practically possible. Therefore, during comparative testing, this ratio should be held at a value representative of a commercially realistic, but low, level for the high ash feedstock in order accurately assess the reduction in NOx formation when using the cleaner refined coal.

During pilot plant testing, the NO/NOx is measured using a Thermo Scientific Chemilluminescent gas analyzer that is calibrated with a certified NO/NOx standard each day and verified at the end of each test. The flue gas sample is collected at the same location for all tests and all fuels. The flue gas comes directly from the furnace in a heated stainless steel tube and passes through a gas conditioning system to knockout moisture. From the knockout trap the gas flows through Teflon tubing through a rotameter to maintain constant flow to the analyzer, flows through the analyzer and is then is exhausted.

VI. Examples

The following examples provide a strong correlation between reducing the ash content of a coal feedstock and reducing NOx emissions. The data provided is illustrative of the inventive nature of the disclosed technology. However, the examples should not be construed as limiting the meaning and scope of the disclosed invention. It will be appreciated that one of skill in the art can and would be expected to draw informed conclusions that would permit making intelligent extrapolations from the disclosed examples and other information contained herein.

Example 1

A NOx emissions test of Wellington coal feedstocks and refined coal fuel products was performed. The combustion test was part of an ongoing program to evaluate the combustion performance and NOx emissions of refined coal products relative to their initial coal feedstocks. During these combustion tests, four samples from the Wellington coal refining facility (Utah) were evaluated. The primary Wellington coal feedstock contained 15.9% ash by dry basis weight and the primary refined product contained 8.5% ash by dry basis weight. The secondary Wellington coal feedstock contained 48.2% ash by dry basis weight and the secondary refined product contained 14.9% ash by dry basis weight. The purpose of these combustion tests was to study the relationship between ash content and NOx emissions.

The operating conditions for this test series were designed to simulate, to the greatest extent possible, actual boiler conditions for a majority of the pulverized coal-fired boilers in the United States. With this in mind, the low-NOx burner was set to produce a swirl number of about 0.9, the secondary or combustion air preheat was set at 500° F., and the velocity in the primary air/coal line was about 55 ft/sec (3300 ft/min). The main parameter varied during these tests was the primary air/fuel ratio. For the feedstock materials, which require higher amounts of air to keep the particles in suspension due to their higher density, air/fuel ratios of 2.2, 2.0 and 1.8 were evaluated. The refined coal products were tested at lower air/fuel ratios of 2.0, 1.8 and 1.6, or about 10% lower than for the feedstock materials. These values cover the range of most pulverized coal fired boilers in the U.S.

The following conclusions were drawn from these tests:

(1) refining the primary Wellington coal feedstock from 15.9% ash (dry basis) to 8.5% ash (dry basis) (i.e., an ash reduction of approximately 45%) and using a 10% lower air/fuel ratio resulted in an average reduction in NOx emissions of 31%; and (2) refining the secondary Wellington coal feedstock from 48.2% ash (dry basis) to 14.9% ash (dry basis) (i.e., an ash reduction of approximately 70%) and using a 10% lower air/fuel ratio resulted in an average reduction in NOx emissions of 54%.

Physical characterization work on ash properties has shown that the density of coal is directly proportional to the ash content. These results are shown in FIG. 2 and are from two different coal sources, one from the west and one from the south. These data were obtained on pulverized coal samples using a Quantachrome helium pycnometer. The data show that as the ash content of the coal decreases, the particle density also decreases. The trend is consistent with what would be expected as ash and components such as iron, silica and aluminum oxide are cleaned out of the feedstock during the refining process. These species are denser than the carbon, hydrocarbon and other volatile components in coal.

Samples of the primary and secondary feedstock materials were collected at the Wellington recovery plant near Price, Utah. These samples were placed into 1-ton rigid-walled Supersacs, labeled, and sent to Taylorsville, Ga. for processing. During processing, each sample was crushed and pulverized using a refurbished and instrumented 1937 Model 352 CE-Raymond bowl mill, which has a rated capacity of 2 tons per hour. This type of mill provides representative milling conditions normally used in power plants. Pulverized samples were 72±5% passing through a 200 mesh screen. Screening was performed using standard mesh screens and following ASTM D-197 procedures. The pulverized coals were stored in Supersacs and transported to Utah for testing at the University of Utah combustion facility in Salt Lake City, Utah. Representative samples from each bag of pulverized coal were collected using a grain thief inserted in several locations within the bag and combined with all samples from bags of the same coal material. This representative sample was then sent to CONSOL Energy for analysis. The results of this analysis are shown in Table 2 below, and are reported on as received and dry bases.

TABLE 1

| PARAMETER | Primary Feedstock | Primary Product | Secondary Feedstock | Secondary Product |
|---|---|---|---|---|
| As Received Basis Proximate (wt. %) | | | | |
| Moisture | 1.78 | 2.39 | 1.25 | 1.86 |
| Volatile Matter | 36.75 | 38.92 | 24.70 | 36.81 |
| Ash | 15.66 | 8.34 | 47.63 | 14.63 |
| Fixed Carbon | 45.81 | 50.35 | 26.42 | 46.70 |
| Ultimate (wt. %) | | | | |
| Carbon | 67.20 | 72.36 | 40.93 | 68.19 |
| Hydrogen | 5.20 | 5.53 | 3.53 | 5.30 |
| Nitrogen | 1.25 | 1.50 | 0.76 | 1.31 |
| Sulfur | 1.22 | 1.22 | 1.27 | 1.04 |
| Oxygen | 3.26 | 1.23 | 5.93 | 2.85 |
| Ash | 15.66 | 8.34 | 47.63 | 14.63 |
| Heating Value (Btu/lb) | 12037 | 13076 | 7036 | 12189 |
| Mercury (ppm) | 0.055 | 0.032 | 0.102 | 0.023 |
| Dry Basis Proximate (wt. %) | | | | |
| Moisture | — | — | — | — |
| Volatile Matter | 37.42 | 39.87 | 25.01 | 37.51 |
| Ash | 15.94 | 8.54 | 48.23 | 14.91 |
| Fixed Carbon | 46.64 | 51.58 | 26.75 | 47.59 |
| Ultimate (wt. %) | | | | |
| Carbon | 68.42 | 74.13 | 41.45 | 69.48 |
| Hydrogen | 5.29 | 5.67 | 3.57 | 5.40 |
| Nitrogen | 1.27 | 1.54 | 0.77 | 1.33 |
| Sulfur | 1.24 | 1.25 | 1.29 | 1.06 |
| Oxygen | 3.32 | 1.26 | 6.01 | 2.90 |
| Ash | 15.94 | 8.54 | 48.23 | 14.91 |
| Heating Value (Btu/lb) | 12255 | 13396 | 7125 | 12420 |
| Mercury (ppm) | 0.056 | 0.033 | 0.103 | 0.023 |
| Dry, Ash Free Basis Proximate (wt. %) | | | | |
| Moisture | — | — | — | — |
| Volatile Matter | 44.51 | 43.60 | 48.32 | 44.08 |
| Ash | — | — | — | — |
| Fixed Carbon | 55.49 | 56.40 | 51.68 | 55.92 |
| Ultimate (wt. %) | | | | |
| Carbon | 81.40 | 81.06 | 80.07 | 81.65 |
| Hydrogen | 6.30 | 6.19 | 6.91 | 6.35 |
| Nitrogen | 1.51 | 1.68 | 1.49 | 1.57 |
| Sulfur | 1.48 | 1.37 | 2.48 | 1.25 |
| Oxygen | 3.95 | 1.38 | 11.61 | 3.41 |
| Ash | — | — | — | — |
| Heating Value (Btu/lb) | 14580 | 14648 | 13764 | 14596 |
| Mercury (ppm) | 0.067 | 0.036 | 0.200 | 0.028 |
| lbs/MMBtu Basis Proximate | | | | |
| Moisture | 1.48 | 1.83 | 1.78 | 1.53 |
| Volatile Matter | 30.53 | 29.76 | 35.11 | 30.20 |
| Ash | 13.01 | 6.38 | 67.69 | 12.00 |
| Fixed Carbon | 38.06 | 38.51 | 37.55 | 38.31 |

TABLE 1-continued

| PARAMETER | Primary Feedstock | Primary Product | Secondary Feedstock | Secondary Product |
|---|---|---|---|---|
| Ultimate | | | | |
| Carbon | 55.83 | 55.34 | 58.17 | 55.94 |
| Hydrogen | 4.32 | 4.23 | 5.02 | 4.35 |
| Nitrogen | 1.04 | 1.15 | 1.08 | 1.07 |
| Sulfur | 1.01 | 0.93 | 1.81 | 0.85 |
| Oxygen | 2.71 | 0.94 | 8.43 | 2.34 |
| Ash | 13.01 | 6.38 | 67.69 | 12.00 |
| Mercury (lbs/TBtu) | 4.57 | 2.45 | 14.50 | 1.89 |

Figure 3:
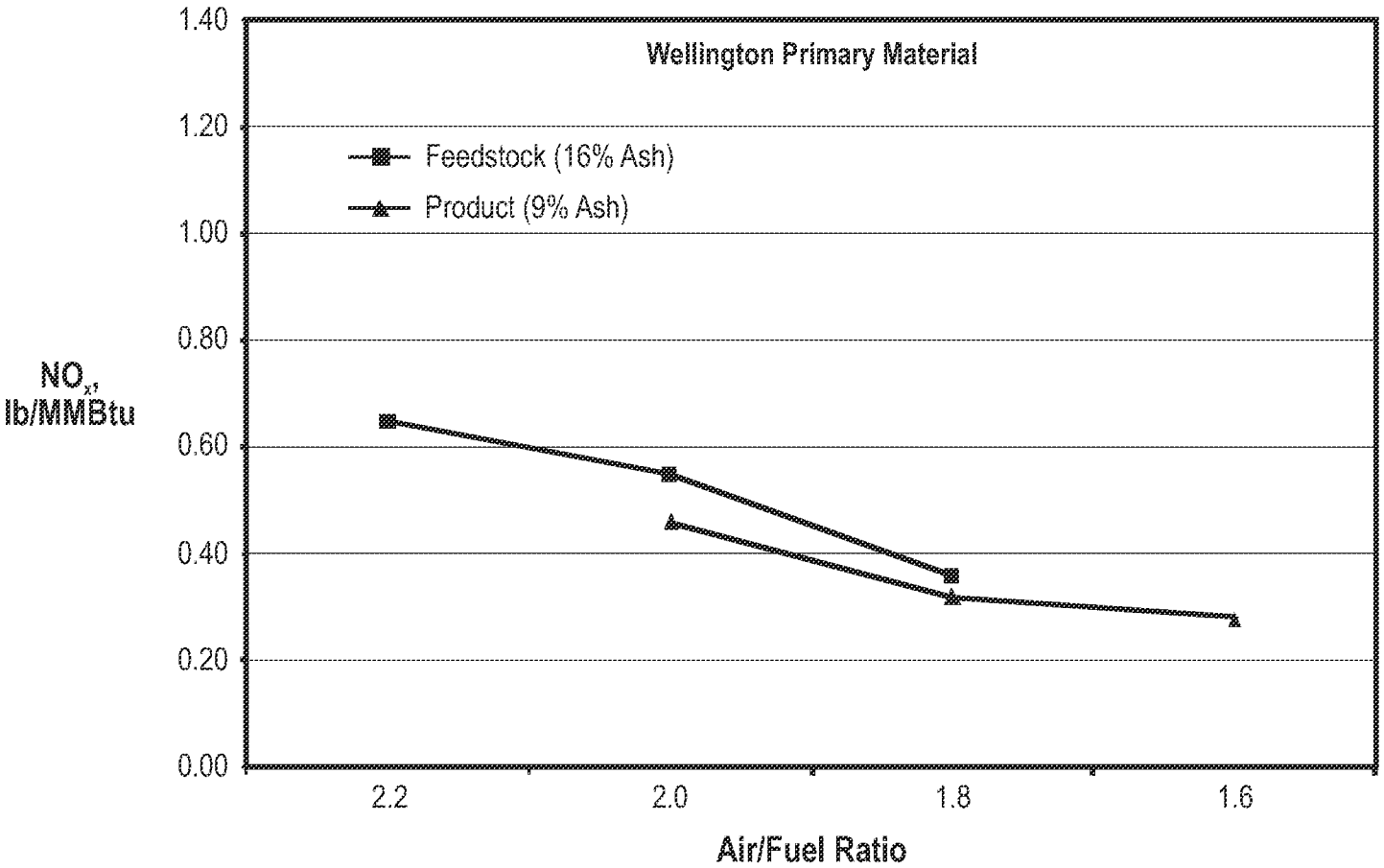
FIG. 3 is a chart that graphically depicts the relationship between NOx emissions and different air/fuel ratios employed during combustion of Wellington primary coal material and a refined fuel product made by removing ash from the primary coal material.
Figure 4:
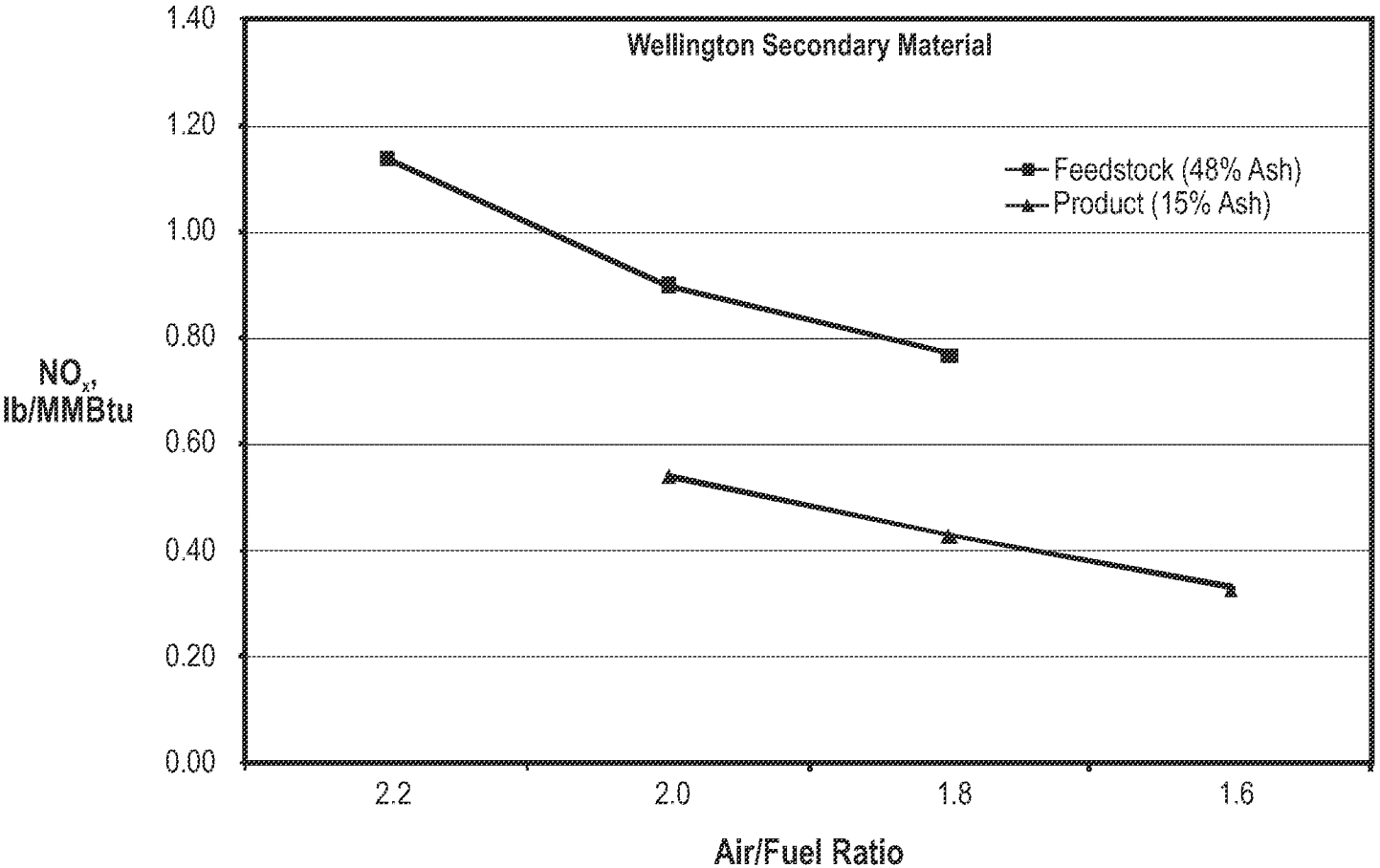
FIG. 4 is a chart that graphically depicts the relationship between NOx emissions and different air/fuel ratios employed during combustion of Wellington secondary coal material and a refined fuel product made by removing ash from the secondary coal material.

The combustion tests were performed in the University of Utah L1500 pilot-scale combustor. FIG. 3 compares the NOx levels for the Wellington Primary feedstock and refined product materials. FIG. 4 compares the NOx levels for the Wellington Secondary feedstock and refined product materials. As predicted, as the air/fuel ratio is lowered, the NOx levels measured during the combustion test were also decreased. This was due to the reduced amount of air in direct contact with the coal as it entered the burner.

Figure 5:
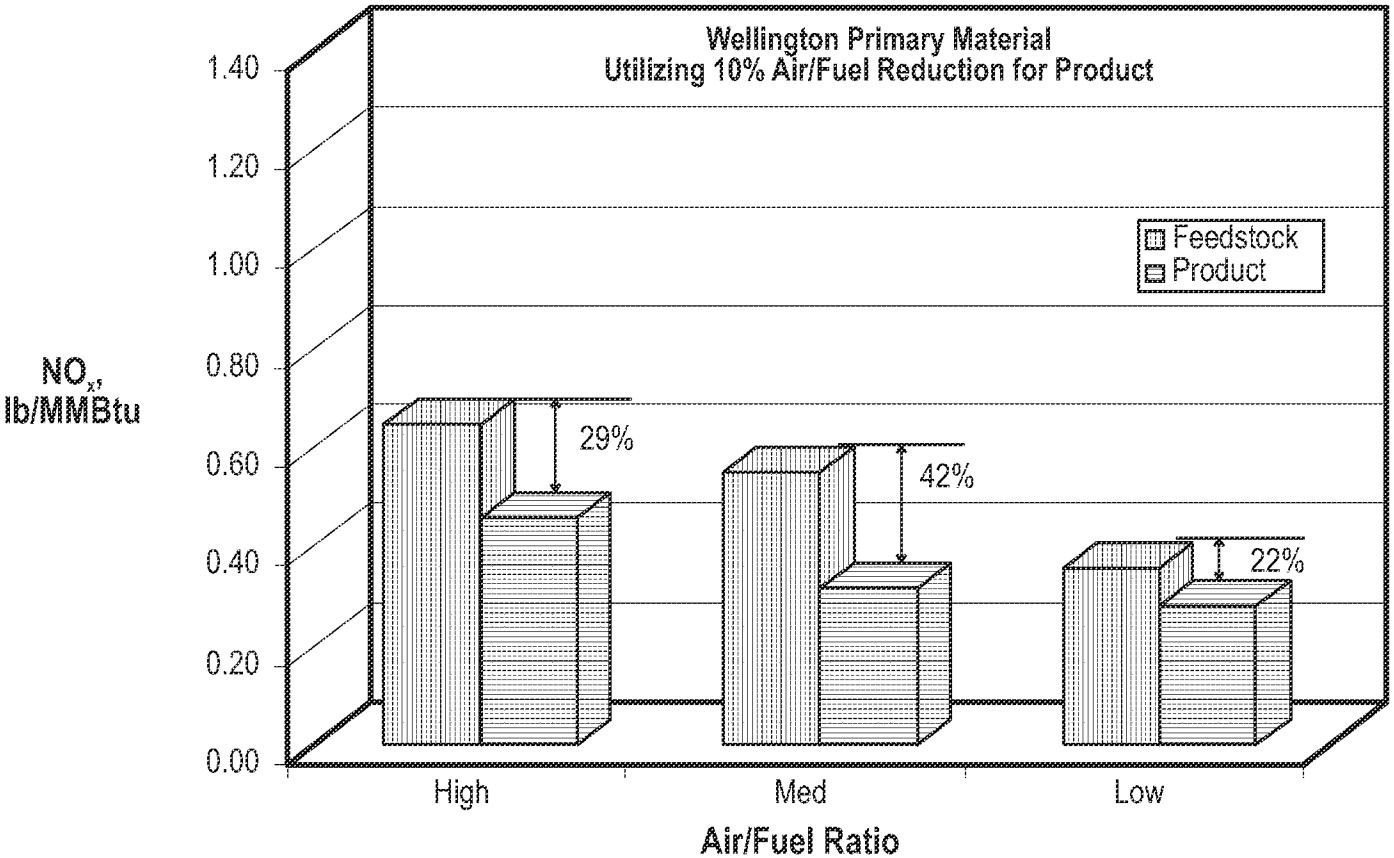
FIG. 5 is a bar diagram that graphically depicts the difference and reduction in NOx emissions during combustion of the primary coal feedstock compared to the refined fuel product at the different air/fuel ratios shown in FIG. 3.
Figure 6:
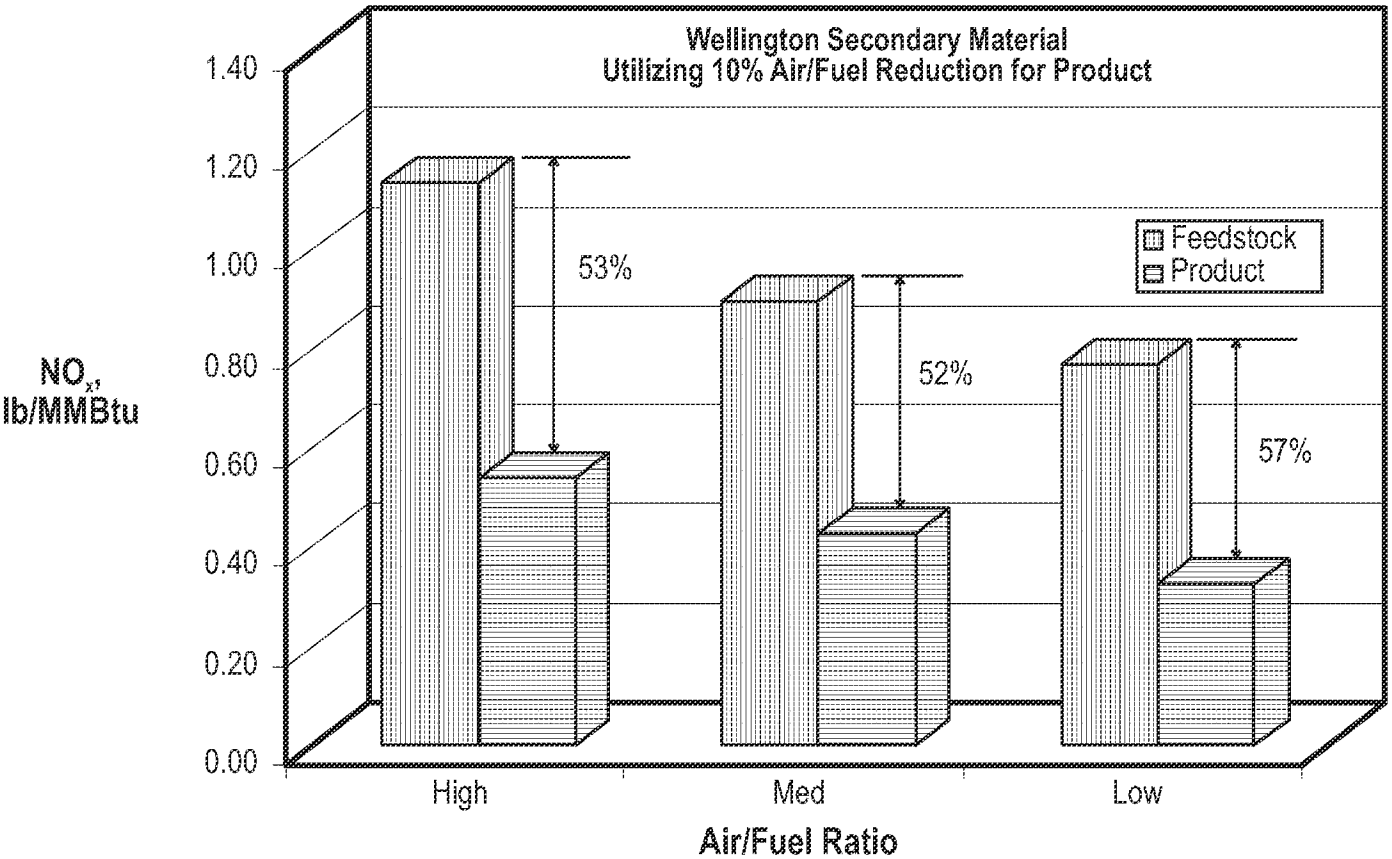
FIG. 6 is a bar diagram that graphically depicts the difference and reduction in NOx emissions during combustion of the secondary coal feedstock compared to the refined fuel product at the different air/fuel ratios shown in FIG. 4.
Figure 7:
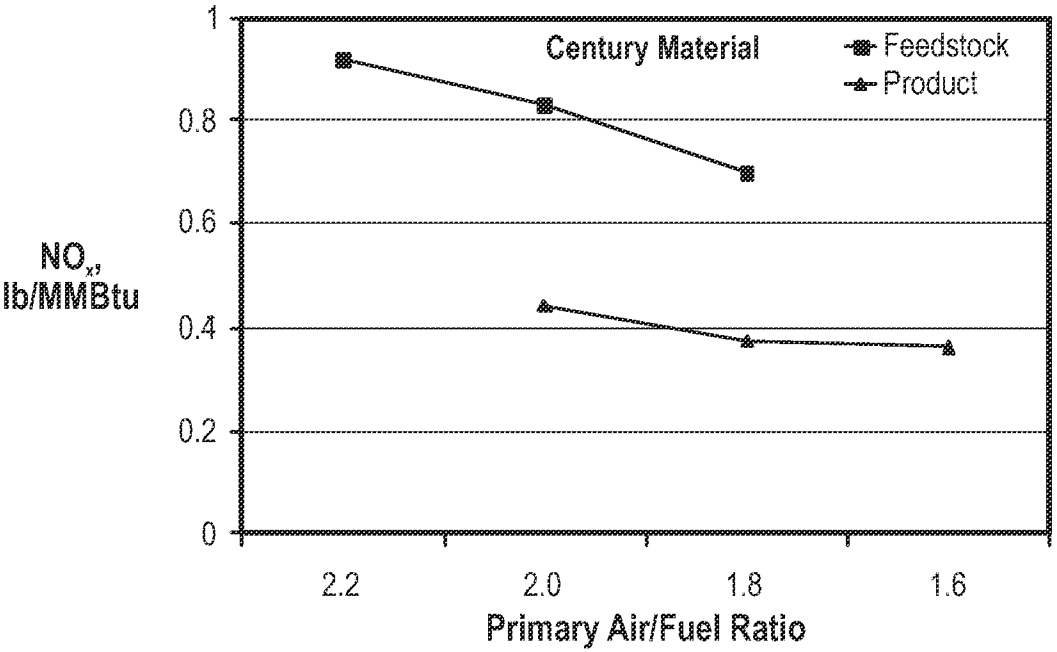
FIG. 7 is a chart that graphically depicts the relationship between NOx emissions and different air/fuel ratios employed during combustion of Century secondary coal material and a refined fuel product made by removing ash from the secondary coal material.

FIGS. 5 and 6 graphically compare and quantify the results shown in FIGS. 3 and 4, respectively. The results show that reducing the air/fuel ratio by approximately 10% reductions yields significantly greater reductions in NOx emissions.

Example 2

A similar test as in Example 1 was performed using Alabama CEF #3 fine coal and refined products. The following conclusions were made from these tests:

(1) refining the CEF #3 feedstock from about 40% ash (dry basis) to about 20% ash (dry basis) and using no overfire air resulted in a NOx emissions reduction of about 50%;

(2) refining the CEF #3 feedstock from about 40% ash (dry basis) to about 20% ash (dry basis) and using 15% overfire air resulted in a NOx emissions reduction of about 50%.

The coal samples were analyzed in the same manner as the samples in Example 1. The results of this analysis are shown in Table 2 below, and are reported on as received and dry bases.

TABLE 2

| PARAMETER | Feedstock 2007 | Produst 2007 |
|---|---|---|
| As Received Basis Proximate (wt. %) | | |
| Moisture | 1.72 | 1.63 |
| Volatile Matter | 15.47 | 17.87 |
| Ash | 40.54 | 18.17 |
| Fixed Carbon | 42.27 | 62.33 |
| Ultimate (wt. %) | | |
| Carbon | 49.93 | 72.91 |
| Hydrogen | 3.37 | 4.92 |
| Nitrogen | 0.80 | 1.23 |
| Sulfur | 0.98 | 0.51 |
| Oxygen | 3.26 | 1.23 |
| Ash | 40.54 | 18.17 |
| Heating Value (Btu/lb) | 8441 | 12591 |
| Mercury (ppm) | 0.026 | 0.018 |
| Dry Basis Proximate (wt. %) | | |
| Moisture | — | — |
| Volatile Matter | 15.74 | 18.17 |

TABLE 2-continued

| PARAMETER | Feedstock 2007 | Produst 2007 |
|---|---|---|
| Ash | 41.25 | 18.47 |
| Fixed Carbon | 49.01 | 63.36 |
| Ultimate (wt. %) | | |
| Carbon | 50.80 | 74.12 |
| Hydrogen | 3.43 | 4.39 |
| Nitrogen | 0.81 | 1.25 |
| Sulfur | 0.39 | 0.52 |
| Oxygen | 3.32 | 1.25 |
| Ash | 41.25 | 18.47 |
| Heating Value (Btu/lb) | 8589 | 12800 |
| Mercury (ppm) | 0.026 | 0.018 |
| Dry, Ash Free Basis Proximate (wt. %) | | |
| Moisture | — | — |
| Volatile Matter | 26.79 | 22.28 |
| Ash | — | — |
| Fixed Carbon | 73.21 | 77.72 |
| Ultimate (wt. %) | | |
| Carbon | 86.47 | 90.91 |
| Hydrogen | 5.84 | 5.38 |
| Nitrogen | 1.38 | 1.53 |
| Sulfur | 0.66 | 0.64 |
| Oxygen | 5.65 | 1.53 |
| Ash | — | — |
| Heating Value (Btu/lb) | 14619 | 15700 |
| Mercury (ppm) | 0.045 | 0.022 |
| lbs/MMBtu Basis Proximate | | |
| Moisture | 2.04 | 1.29 |
| Volatile Matter | 18.33 | 14.19 |
| Ash | 48.03 | 14.43 |
| Fixed Carbon | 56.08 | 49.50 |
| Ultimate | | |
| Carbon | 59.15 | 57.91 |
| Hydrogen | 3.89 | 3.43 |
| Nitrogen | 0.94 | 0.98 |
| Sulfur | 0.45 | 0.41 |
| Oxygen | 3.87 | 0.98 |
| Ash | 48.03 | 14.43 |
| Mercury (lbs/TBtu) | 3.08 | 1.43 |

Example 3

NOx emissions tests were performed using an eastern bituminous secondary coal material from eastern Kentucky (Century Material). The results of these tests are graphically depicted in FIG. 7. The NOx emissions reductions were on average about 50%.

Example 4

NOx emissions tests were performed using an Illinois Basin secondary coal material from Indiana (Chinook Material). The results of these tests are graphically depicted in FIG. 8. The NOx emissions reductions averaged about 25%.

Example 5

NOx emissions tests were performed using an Illinois Basin secondary coal material from Kentucky (Minuteman Material). The results of these tests are graphically depicted in FIG. 8. The NOx emissions reductions averaged about 25%.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for reducing an air/fuel ratio required to convey pulverized coal through feeder pipes of a coal burner in suspended condition without settling out and into a primary combustion zone of the coal burner, the method comprising, obtaining an initial coal having a dry basis ash content and density such that pulverized initial coal with 70% passing through a 200 mesh screen and at least 99% passing through a 50 mesh screen made from the initial coal requires a first air/fuel ratio to maintain the pulverized initial coal in suspended condition without settling out when conveyed through the feeder pipes of the coal burner;

cleaning the initial coal to reduce the dry basis ash content by at least about 20% and thereby yield a refined coal having a reduced density compared to the density of the initial coal;

pulverizing the refined coal to yield pulverized refined coal;

conveying the pulverized refined coal in suspended condition without settling out through the feeder pipes of the coal burner to the primary combustion zone using a second air/fuel ratio that is reduced by at least about 5% compared to the first air/fuel ratio required to maintain pulverized initial coal in suspended condition without settling out when conveyed through the feeder pipes of the coal burner; and burning the pulverized refined coal in the primary combustion zone of the coal burner.

2. A method as in claim 1, the initial coal comprising primary coal having a dry basis ash content of at least about 15%, the refined coal being cleaned to have a dry basis ash content of less than about 10%.

3. A method as in claim 1, the initial coal comprising a secondary or waste coal feedstock having a dry basis ash content of at least about 40%, the refined coal being cleaned to have a dry basis ash content of less than about 20%.

4. A method as in claim 1, the refined coal being cleaned to have a dry basis ash content that is less than about 80% of the first dry basis ash content of the initial coal.

5. A method as in claim 1, the refined coal being cleaned to have a dry basis ash content that is less than about 60% of the first dry basis ash content of the initial coal.

6. A method as in claim 1, the refined coal being cleaned to have a dry basis ash content that is less than about 40% of the first dry basis ash content of the initial coal.

7. A method as in claim 1, the refined coal having a mercury content of less than about 50% of the mercury content of the initial coal.

8. A method as in claim 1, the initial coal being cleaned by at least one of dry jigging or wet processing.

9. A method as in claim 1, wherein the quantity of air used in conveying the pulverized refined coal in suspended condition through the feeder pipes of the coal burner to the primary combustion zone is reduced by at least about 5% compared to the quantity of air required to maintain pulverized initial coal in suspended condition without settling out when conveyed through the feeder pipes of the coal burner.

10. A method as in claim 1, wherein the quantity of air used in conveying the pulverized refined coal in suspended condition through the feeder pipes of the coal burner to the primary combustion zone is reduced by at least about 10% compared to the quantity of air required to maintain pulverized initial coal in suspended condition without settling out when conveyed through the feeder pipes of the coal burner.

11. A method as in claim 1, the initial coal having a first dry basis ash content such that pulverized initial coal made from the initial coal requires a first minimum air/fuel ratio in the primary combustion zone to maintain a stable flame, wherein burning the pulverized refined coal in the primary combustion zone of the coal burner maintains a stable flame while using a second minimum air/fuel ratio in the primary combustion zone that is reduced by at least 10% compared to the less than the first minimum air/fuel ratio required to maintain a stable flame when burning initial pulverized coal in the coal burner.

12. A method as in claim 11, the second minimum air/fuel ratio being reduced by at least about 15% compared to the first minimum air/fuel ratio required to maintain a stable flame when burning initial pulverized coal in the coal burner.

13. A method as in claim 1, the second air/fuel ratio being reduced by at least about 10% compared to the first air/fuel ratio.

14. A method as in claim 1, the second air/fuel ratio being reduced by at least about 15% compared to the first air/fuel ratio.

15. A method as in claim 11, further comprising operating the coal burning using an increased quantity of secondary and/or tertiary air to complete combustion compared to a quantity of secondary and/or tertiary air required to complete combustion when burning initial pulverized coal in the coal burner using the first minimum air/fuel ratio in the primary combustion zone.

16. A method as in claim 15, the increased quantity of secondary and/or tertiary air resulting in a lower combustion temperature of the coal burner compared to a temperature of the coal burner when burning initial pulverized coal in the coal burner using the first minimum air/fuel ratio in the primary combustion zone.

17. A method as in claim 16, wherein burning the pulverized refined coal in the coal burner using the second air/fuel ratio in the primary combustion zone and the increased quantity of secondary and/or tertiary air results in the coal burner emitting a second quantity of NOx that is reduced by at least about 10% compared to a first quantity of NOx produced when burning the initial coal in the coal burner.

18. A method as in claim 16, wherein burning the pulverized refined coal in the coal burner using the second air/fuel ratio in the primary combustion zone and the increased quantity of secondary and/or tertiary air results in the coal burner emitting a second quantity of NOx that is reduced by at least about 20% compared to a first quantity of NOx produced when burning the initial coal in the coal burner.

19. A method as in claim 16, wherein burning the pulverized refined coal in the coal burner using the second air/fuel ratio in the primary combustion zone and the increased quantity of secondary and/or tertiary air results in the coal burner emitting a second quantity of NOx that is reduced by at least about 30% compared to a first quantity of NOx produced when burning the initial coal in the coal burner.

20. A method as in claim 16, wherein burning the pulverized refined coal in the coal burner using the second air/fuel ratio in the primary combustion zone and the increased quantity of secondary and/or tertiary air results in the coal burner emitting a second quantity of NOx that is reduced by at least about 50% compared to a first quantity of NOx produced when burning the initial coal in the coal burner.

21. A method for reducing an air/fuel ratio required to convey pulverized coal through feeder pipes of a coal burner in suspended condition without settling out and into a primary combustion zone of the coal burner, the method comprising, obtaining an initial coal having a dry basis ash content of at least 30% and a density such that pulverized initial coal with 70% passing through a 200 mesh screen and at least 99% passing through a 50 mesh screen made from the initial coal requires a first air/fuel ratio to maintain the pulverized initial coal in suspended condition without settling out when conveyed through the feeder pipes of the coal burner;

cleaning the initial coal to reduce the dry basis ash content by at least about 20% and thereby yield a refined coal having a second dry basis ash content of less than about 20% and a reduced density compared to the density of the initial coal;

pulverizing the refined coal to yield pulverized refined coal;

conveying the pulverized refined coal in suspended condition without settling out through the feeder pipes of the coal burner to the primary combustion zone using a second air/fuel ratio that is reduced by at least about 5% compared to the first air/fuel ratio required to maintain pulverized initial coal in suspended condition without settling out when conveyed through the feeder pipes of the coal burner;

burning the pulverized refined coal in the primary combustion zone of the coal burner with an air/fuel ratio on a mass/mass basis of less than about 2; and introducing a secondary air and/or tertiary air into the coal burner so as to maintain a combustor exit oxygen level of at least about 1%.

22. A method for reducing an air/fuel ratio required to convey pulverized coal through feeder pipes of a coal burner in suspended condition without settling out and into a primary combustion zone of the coal burner, the method comprising, providing a refined coal obtained by cleaning an initial coal having a first dry basis ash content, a first density, and a first carbon content such that pulverized initial coal with 70% passing through a 200 mesh screen and at least 99% passing through a 50 mesh screen made from the initial coal requires a first air/fuel ratio to maintain the pulverized initial coal in suspended condition without settling out when conveyed through the feeder pipes of the coal burner, the refined coal having a second dry basis ash content that is reduced by at least about 20% compared to the first dry basis ash content of the initial coal, a second density lower than the first density, and a second carbon content greater than the first carbon content;

pulverizing the refined coal to yield pulverized refined coal;

conveying the pulverized refined coal in suspended condition without settling out through the feeder pipes of the coal burner to the primary combustion zone using a second air/fuel ratio that is reduced by at least about 5% compared to the first air/fuel ratio required to maintain pulverized initial coal in suspended condition without settling out when conveyed through the feeder pipes of the coal burner; and burning the pulverized refined coal in the primary combustion zone of the coal burner.

23. A method for reducing an air/fuel ratio required to convey pulverized coal through feeder pipes of a coal burner in suspended condition without settling out and into a primary combustion zone of the coal burner, the method comprising, providing a refined coal obtained by cleaning an initial coal having a dry basis ash content of at least 30% and a first density such that pulverized initial coal with 70 % passing through a 200 mesh screen and at least 99% passing through a 50 mesh screen made from the initial coal requires a first air/fuel ratio to maintain the pulverized initial coal in suspended condition without settling out when conveyed through the feeder pipes of the coal burner, the refined coal having a second dry basis ash content of less than about 20% and a second density that is lower than the first density;

pulverizing the refined coal to yield pulverized refined coal;

conveying the pulverized refined coal in suspended condition without settling out through the feeder pipes of the coal burner to the primary combustion zone using a second air/fuel ratio that is reduced by at least about 5% compared to the first air/fuel ratio required to maintain pulverized initial coal in suspended condition without settling out when conveyed through the feeder pipes of the coal burner; and burning the pulverized refined coal in the primary combustion zone of the coal burner.

24. A method for reducing the air/fuel ratio required to convey pulverized coal through feeder pipes of a coal burner in suspended condition, prevent coal lay-down in the feeder pipes, and maintain a stable flame within a primary combustion zone of the coal burner, the method comprising, providing a refined coal obtained by cleaning an initial coal having a first dry basis ash content, a first density, and a first carbon content such that pulverized initial coal made from the initial coal requires a first air/fuel ratio to maintain the pulverized initial coal in suspended condition without settling out when conveyed through the feeder pipes of the coal burner and maintain a stable flame within the primary combustion zone of the coal burner, the refined coal having a second dry basis ash content that is reduced by at least about 20% compared to the first dry basis ash content of the initial coal, a second density lower than the first density, and a second carbon content greater than the first carbon content;

pulverizing the refined coal to yield pulverized refined coal;

conveying the pulverized refined coal in suspended condition through the feeder pipes of the coal burner to the primary combustion zone using a second air/fuel ratio that is reduced by at least about 5% compared to first air/fuel ratio yet maintains the pulverized refined coal in suspended condition without coal lay-down when conveying it through the feeder pipes of the coal burner and maintains a stable flame within the primary combustion zone of the coal burner; and burning the pulverized refined coal in the primary combustion zone of the coal burner and maintaining a stable flame using the second air/fuel ratio.

* * * * *

UNITED STATES PATENT AND TRADEMARK OFFICE

CERTIFICATE OF CORRECTION

PATENT NO. : 8,539,891 B2
APPLICATION NO. : 13/632684
DATED : September 24, 2013
INVENTOR(S) : Minkara et al.

It is certified that error appears in the above-identified patent and that said Letters Patent is hereby corrected as shown below:

Title Page 1 Column 2
In Abstract Line 14, change "combustion air and result" to --combustion air and results--

In the Specification

Column 1
Line 31, change "require emission" to --require emissions--

Column 2
Line 30, change "invention provides methods" to --invention provide methods--

Column 3
Line 36, change "primary are" to --primary air--
Line 49, change "burning low ash" to --burning, low ash--

Column 4
Line 15, change "low, level" to --low level--

Column 7
Line 26, change "air by." to --air.--
Line 47, change "allmineral LLC" to --Allmineral LLC--

Column 8
Line 20, change "of the each" to --of each--
Line 55, change "level-out fluctuations" to --level out fluctuations--

Column 9
Line 66, change "feedstock translate" to --feedstock translates--

Signed and Sealed this
Twenty-fourth Day of December, 2013

Margaret A. Focarino

Margaret A. Focarino
*Commissioner for Patents of the United States Patent and Trademark Office*

Column 10
Line 53-54, change "preferably preferably by at least" to --preferably by at least--

Column 11
Line 13, change "weight more preferably" to --weight, more preferably--
Line 19, change "directly relate" to --directly relates--

Column 15
Line 48, change "low, level" to --low level--
Line 49, change "in order accurately" to --in order to accurately--

Figure 8:
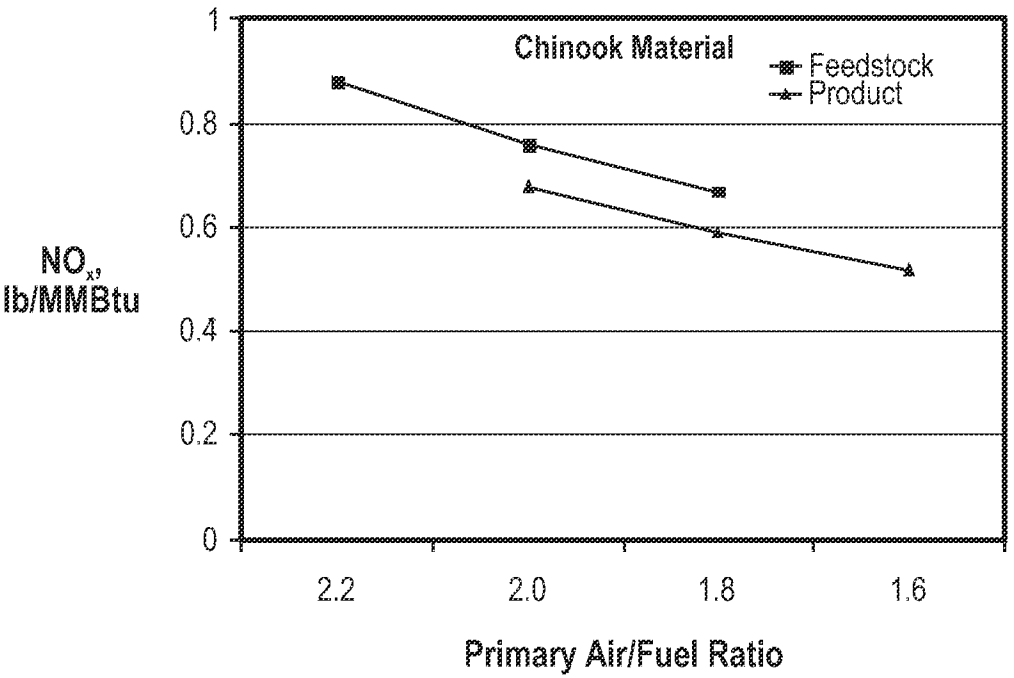
FIG. 8 is a chart that graphically depicts the relationship between NOx emissions and different air/fuel ratios employed during combustion of Chinook secondary coal material and a refined fuel product made by removing ash from the secondary coal material.
Figure 9:
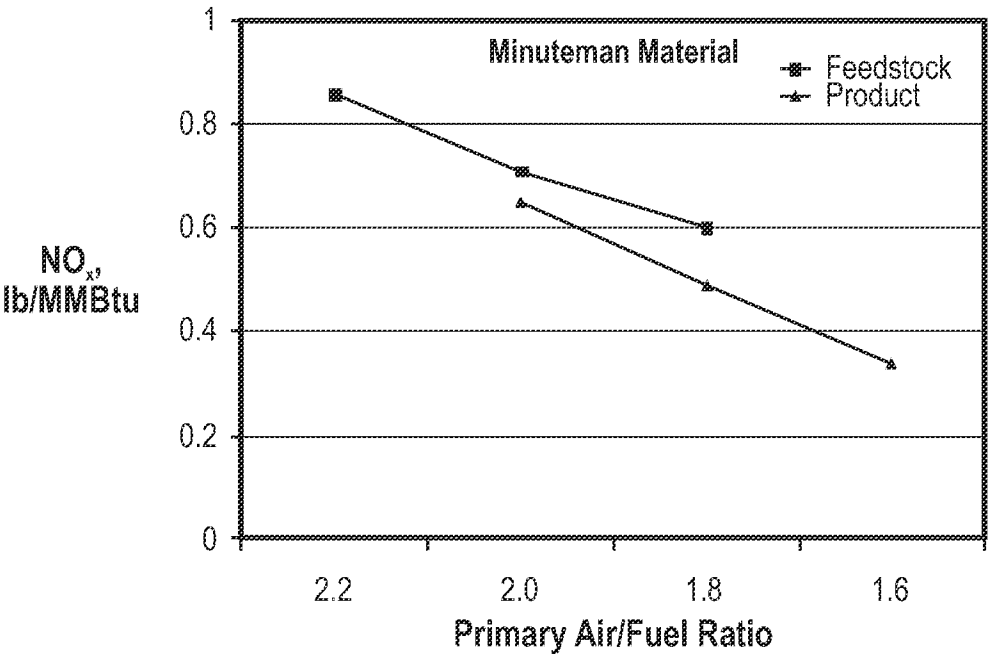
FIG. 9 is a chart that graphically depicts the relationship between NOx emissions and different air/fuel ratios employed during combustion of Minuteman secondary coal material and a refined fuel product made by removing ash from the secondary coal material.

Column 19
Line 64, change "FIG. 8" to --FIG. 9--